US006681924B2

(12) United States Patent
Renzello

(10) Patent No.: US 6,681,924 B2
(45) Date of Patent: Jan. 27, 2004

(54) PAINT AND PAINTBRUSH CARRIER

(76) Inventor: Damian J. Renzello, 1325 Vermont Rte. 14 South, East Montpelier, VT (US) 05651

( * ) Notice: Subject to any disclaimer, the term of this patent is extended or adjusted under 35 U.S.C. 154(b) by 0 days.

(21) Appl. No.: 09/768,118

(22) Filed: Jan. 23, 2001

(65) Prior Publication Data

US 2003/0034350 A1 Feb. 20, 2003

(51) Int. Cl.[7] ..... A45D 44/18
(52) U.S. Cl. ..... 206/15.2; 206/209; 215/228
(58) Field of Search ..... 206/209, 361, 206/209.1, 362.2, 362.3, 15.2, 15.3; 220/735; 215/228, 390, 391; 224/148.4, 269, 904

(56) References Cited

U.S. PATENT DOCUMENTS 1,008,856 A * 11/1911 Mosher ..... 206/209.1
2,262,753 A * 11/1941 Brennan ..... 206/361
2,273,959 A * 2/1942 Holzer ..... 206/209
2,654,504 A * 10/1953 Hyams ..... 206/361
2,945,251 A * 7/1960 Eichner ..... 206/209.1
3,026,998 A * 3/1962 Scully ..... 206/361
3,406,812 A * 10/1968 Henry ..... 206/209
4,491,234 A * 1/1985 Wilcock ..... 206/361
4,982,471 A * 1/1991 Bannan ..... 206/361
5,992,617 A * 11/1999 Couch et al. ..... 206/15.3
6,050,408 A * 4/2000 Testa ..... 206/361
6,213,329 B1 * 4/2001 Dobson ..... 220/212

* cited by examiner

*Primary Examiner*—Shian Luong
(74) *Attorney, Agent, or Firm*—Cesari and McKenna, LLP

(57) ABSTRACT

A paint and paintbrush carrier comprising a container having a hollow interior for the storage therein of wet paint, a hollow handle communicating with the hollow interior for pouring wet paint therethrough, a first opening for accessing the wet paint, and a second opening sized and shaped for the removable attachment of a paintbrush therein, the first opening and the second opening both communicating with the hollow interior, the first and second opening further communicating with one another.

6 Claims, 8 Drawing Sheets

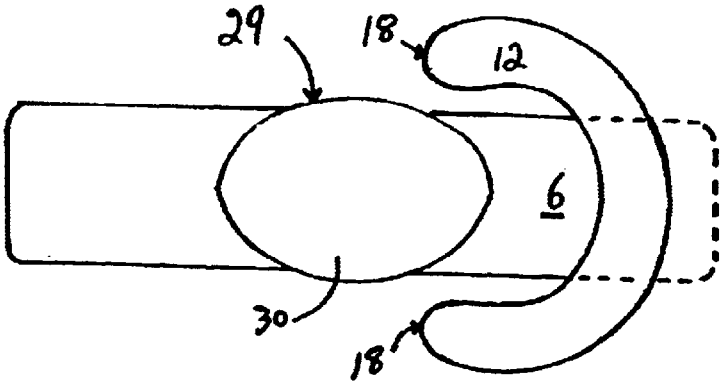
FIG. 9
FIG. 10
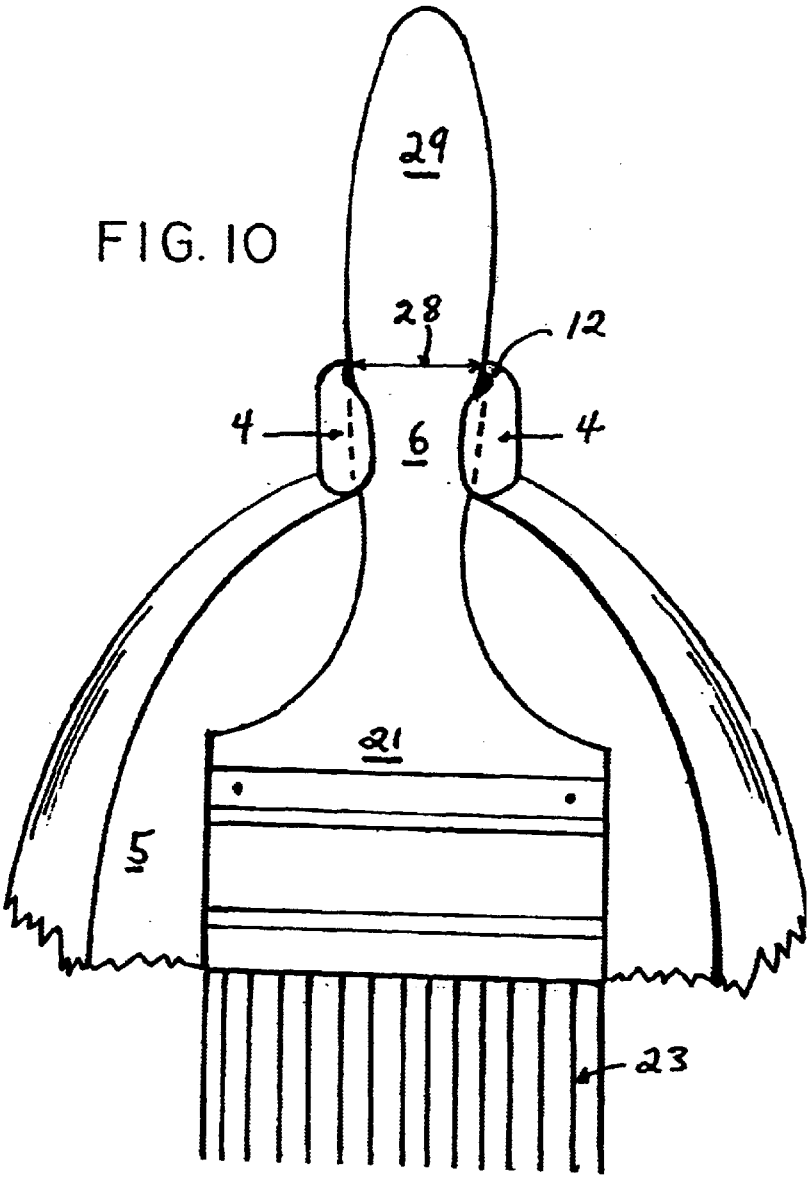

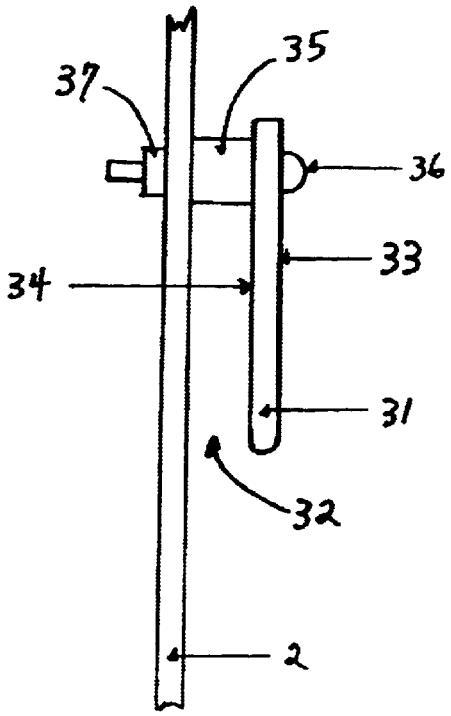
FIG. 11
FIG. 12
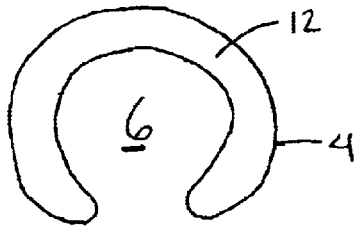
FIG. 13
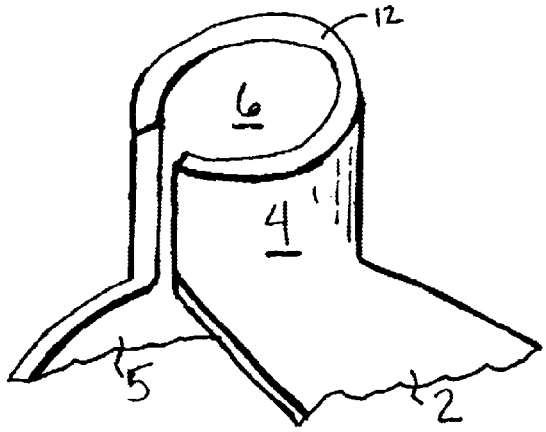

PAINT AND PAINTBRUSH CARRIER

CROSS REFERENCE TO OTHER APPLICATIONS

This is the first submission of an application for this article of manufacture. There are no other applications, provisional or non provisional.

FEDERALLY SPONSORED RESEARCH AND DEVELOPMENT

There are no federally sponsored or funded research or development projects or undertakings in any way associated with the instant invention.

BACKGROUND OF THE INVENTION

1. Field of the Invention

The instant invention relates to that field of devices consisting of articles of manufacture known as painting accessories. Specifically, the instant invention is a container adapted for carrying both paint and paintbrush.

2. Background Information

The prior art discloses that paint buckets and other sorts of paint carriers are well known. Such carriers include buckets having a hollow interior accessible through a large top opening into which paint may be poured, and paint pans such as the sort most often used in conjunction with roller-type applicators.

More often than not, when working with a brush, a painter will simply leave the paint in the can in which the paint is obtained, and paint directly out of that can. In such a situation, it is usually desirable to prevent paint from slopping onto the surface upon which the can is placed. This is usually accomplished by placing a covering on the floor and setting the can down on the covering, or simply placing the can directly on an appropriate area of a ladder. With the can in reach, the painter may then dip the paintbrush into the can, and paint until re-dipping becomes necessary.

It is further known that paintbrushes can become problematic once saturated with paint. An individual using a paint soaked brush often finds him/herself in the difficult position of trying to locate a suitable place upon which to place the brush when free hands are required. More often than not, the place of choice is directly atop the open can. This is usually accomplished by setting the brush down atop the paint can opening such that the brush sets on the rim, the handle extends across the can opening, and the opposite end of the handle sets upon the can rim.

With the brush set down atop the open can in this manner, it is quite common for wet paint to be transferred to the handle. In turn, this wet paint frequently is transferred from the paintbrush handle to the hand of the painter upon picking the brush up for continued use.

Another common solution to the problem of where to place a wet paintbrush is to set it down upon a covered surface, just as can be done with the paint can. For example, if one has placed newspaper upon the floor in order to guard against splattering the floor while painting, it is a well known practice to place the wet paintbrush directly down onto the covered surface. Unfortunately, this often leads to a "soaking through" of the paint whereby the paint on the paint-soaked brush, under the force of gravity, flows from the brush bristles and onto the surface covering. The paint then puddles on the covering, and frequently soaks right through that covering, resulting in wet paint coming into direct contact with the surface sought to be protected by the covering.

Still another common practice for dealing with the problem of "where to put a wet paintbrush" is to use the lid from the open paint can to serve as a surface upon which the wet brush may be placed. This works reasonably well, the first few times the brush is placed down upon the lid. However, it is also known that the wet paint lying on the paint can lid will tend to dry out as it is exposed to air. Each time the wet paintbrush is placed down upon the lid, more and more wet paint will be deposited thereupon. The combination of fresh wet paint and somewhat dry or drying paint most often results in a pasty, lumpy and or crusty covering of paint on the lid. Paint having these sorts of consistency problems is highly undesirable. Worse still, just as the wet brush tends to leave some of its wet paint on the lid, when placed there momentarily, the wet brush also tends to pick up some of the undesirable consistency paint when lifted off that can lid. Using a brush having thereupon paint of an undesirable consistency frequently leads to the transferal of the undesirable paint onto the surface which is being painted. In other words, pasty/lumpy/crusty paint finds its way directly onto the nice newly painted surface. Such a situation usually requires the removal of the undesired paint, and a repainting of the area which has been contaminated.

Another issue of worthy of note often arises when placing the brush down upon any dry surface, and leaving the brush exposed to air there for any length of time. That is, wet paint found on the brush at the moment the brush is laid down frequently dries somewhat before the brush is used again. Paint which has dried is likely to "clog" the brush. A clogged brush is much less efficient than a clean brush. The bristles of the brush tend to stick together and cause fresh paint to be applied in a lumpy or uneven consistency, or even mar the smooth new paint.

Another common problem associated with painting is the contamination of the wet paint by foreign objects. This can occur when painting directly out of the paint can. In such a situation, it is not unusual for dust, dirt and other contaminants to fall into or otherwise find their way through the open top of the paint can and into the wet paint. Such contamination is just as likely to occur when the paint has been poured out of the can and into a "pan" or similar paint container. Furthermore, the incidence of contamination is increased multi-fold when the paintbrush is set down in the open when not in use. Because the paint is wet (whether in the can, in a pan, or just on the brush), any dirt, dust or other contaminants easily adhere to the wet paint upon contact.

Finally, while many ladders have included thereupon a folding shelf for setting a paint can down, others have no such shelf. This is especially true of the taller and/or telescoping ladders most often employed when painting the exterior walls of a building. The absence of a convenient place upon which to set the paint can and paint brush often forces the painter to climb the ladder while holding the paint can in one hand, thus requiring a one-handed climb of the ladder. Obviously, climbing a ladder in such a fashion can be quite dangerous.

SUMMARY OF THE INVENTION

The instant invention is paint and paintbrush carrier designed to function as a single unit, acting to both carry paint which is to be applied by a brush, and to serve as a holder for that paintbrush when the paintbrush is temporarily not in use. The instant invention further has the desirable qualities of reducing paint contamination, and simplifying paintbrush cleaning.

Unlike the prior art, the present invention incorporates features which permit paint to be efficiently carried in a quantity sufficient for extended painting, while at the same time permitting the carrying of an amount less than a full can of paint, if so desired. Furthermore, the instant invention makes it possible to safely and efficiently set the brush down so that the painter's hands are free to accomplish another task while painting. Additionally, the instant invention decreases the chances that wet paint upon the brush will become somewhat dry, thus decreasing the chances that the brush will become clogged.

A first object of the instant invention, therefore, is to provide for an easy to carry (hands free) paint container which may be filled with sufficient paint as required by a particular painting task.

This objective is accomplished by fabricating a container having a first opening into which paint may be poured from a paint can, occupying a storage space within the container, in a quantity deemed sufficient by the painter.

This objective is further accomplished in another embodiment wherein a carry handle is incorporated into the container.

This objective is further accomplished in yet another embodiment wherein a belt attachment means is provided for on the container.

A second object of the invention is to provide a device which is capable of serving as a paintbrush holder for the purpose of safely holding the paintbrush when it is wet with paint, but not momentarily in use.

This objective is accomplished by including a second opening which is sized and shaped for closely and removably accepting a paintbrush handle. Because the paintbrush handle is held by a portion of the container which is not likely to be covered with wet paint, the possibility of the handle coming in contact with the wet paint is diminished.

A third object of the invention is to provide a paintbrush holder which will permit wet paint on the paintbrush to flow out of the bristles and thus decrease the opportunity for the paint to clog the bristles of the paintbrush.

This objective is accomplished by incorporating the second opening in a portion of the container which is located above the paint storage area of the container such that gravity tends to drain the wet paint downwardly, away from the bristles so that the wet paint does not build up as quickly as it would if the brush were merely set down upon a surface and the paintbrush was allowed to set in the puddle of wet paint which inevitably forms wherever the paintbrush is placed when not in use.

A fourth object of the invention is to reduce the opportunity for foreign substances to become incorporated into the wet paint and be transferred via the paintbrush to the surface which is being painted.

This objective is accomplished through the use of a container having a first opening into which wet paint may be poured, and which is sufficiently large for the passage therethrough of the paintbrush, the container providing a sheltered area in which to house paint which is being used, thus decreasing the opportunity for foreign objects to contaminate the wet paint.

This objective is further accomplished through the use of a container having a second opening for closely accepting a paintbrush handle, the paintbrush being placed through the first opening, the handle being closely engaged by the second opening, thus safely storing the paint soaked bristles of the brush within the sheltered area and reducing the opportunity for contact with airborne contaminants.

A fifth object of the instant invention is to provide for a paint and paintbrush container which permits the storage of the paintbrush in direct contact with the wet paint for a more extended period, thus reducing the opportunity for wet paint to dry and consequently clog the paintbrush.

This objective is accomplished by filling the container with a sufficient quantity of wet paint such that when the paintbrush is held in place in the second opening, the paintbrush bristles are submerged in the wet paint, decreasing the opportunity for the paint to dry on the bristles in the event that the user of the paintbrush must desist painting for a longer period of time, but not for so long a period of time so as to make cleaning of the brush worthwhile.

A sixth object of the instant invention is to provide a container capable of not only accepting paint and holding a paintbrush, but also of serving as a convenient paintbrush pre-soak area prior to brush bristle cleaning.

This objective is accomplished by placing a sufficient quantity of an appropriate paint solvent into the container such that the paintbrush may be removably engaged into the second opening with its bristles submerged in the solvent. In such an arrangement, the bristles tend to soak more evenly than if the brush is merely laid down flat (horizontally) in a container having solvent. Furthermore, because the paint is generally more dense than the solvent, the paint tends to flow downwardly, away from the brush, under the force of gravity, thus permitting increased access to the bristles by the solvent and consequently making soaking both easier and more efficient by reducing the time and effort required to clean the paintbrush bristles.

A seventh object of the instant invention is to reduce the amount of paint which is wasted when a wet paintbrush is put down momentarily.

This objective is accomplished by placing the second opening above the paint storage area such that when the brush is hung within the second opening, the wet paint on the brush bristles tends to drip from the brush downwardly into the reservoir of wet paint. Wet paint dripping from the brush when the brush is momentarily not in use is thereby returned to the available pool of paint, rather than having the wet paint merely puddling on a covering from which it may not be easily recovered.

An eighth object of the invention is to simplify the process of returning paint which is temporarily stored within the container, back into the container in which the paint is stored for extended periods of time. Most often, the latter container is the can in which the paint was originally purchased.

This objective is accomplished in one embodiment by incorporating into the paint and paintbrush carrier a hollow handle which communicates at both ends of the hollow handle with the invention's storage area, and thereby permits passage therethrough of paint within the storage area and out of the second opening, the second opening acting essentially as a funnel.

A DESCRIPTION OF THE DRAWINGS

FIG. 9 is an overhead plan view of the paintbrush handle being inserted through the second opening in the paint and paintbrush carrier.

FIG. 10 is a partial front elevational view of the paintbrush handle seated within the second opening of the paint and paintbrush carrier.

FIG. 11 is a detail view of a portion of the paint and paintbrush container side wall with belt attachment means.

FIG. 12 is an overhead plan view of a portion of the paint and paint brush container neck and second opening.

FIG. 13 is a perspective view of a portion of the paint and paint brush container neck and second opening.

A DESCRIPTION OF THE PREFERRED EMBODIMENT

Figure 1:
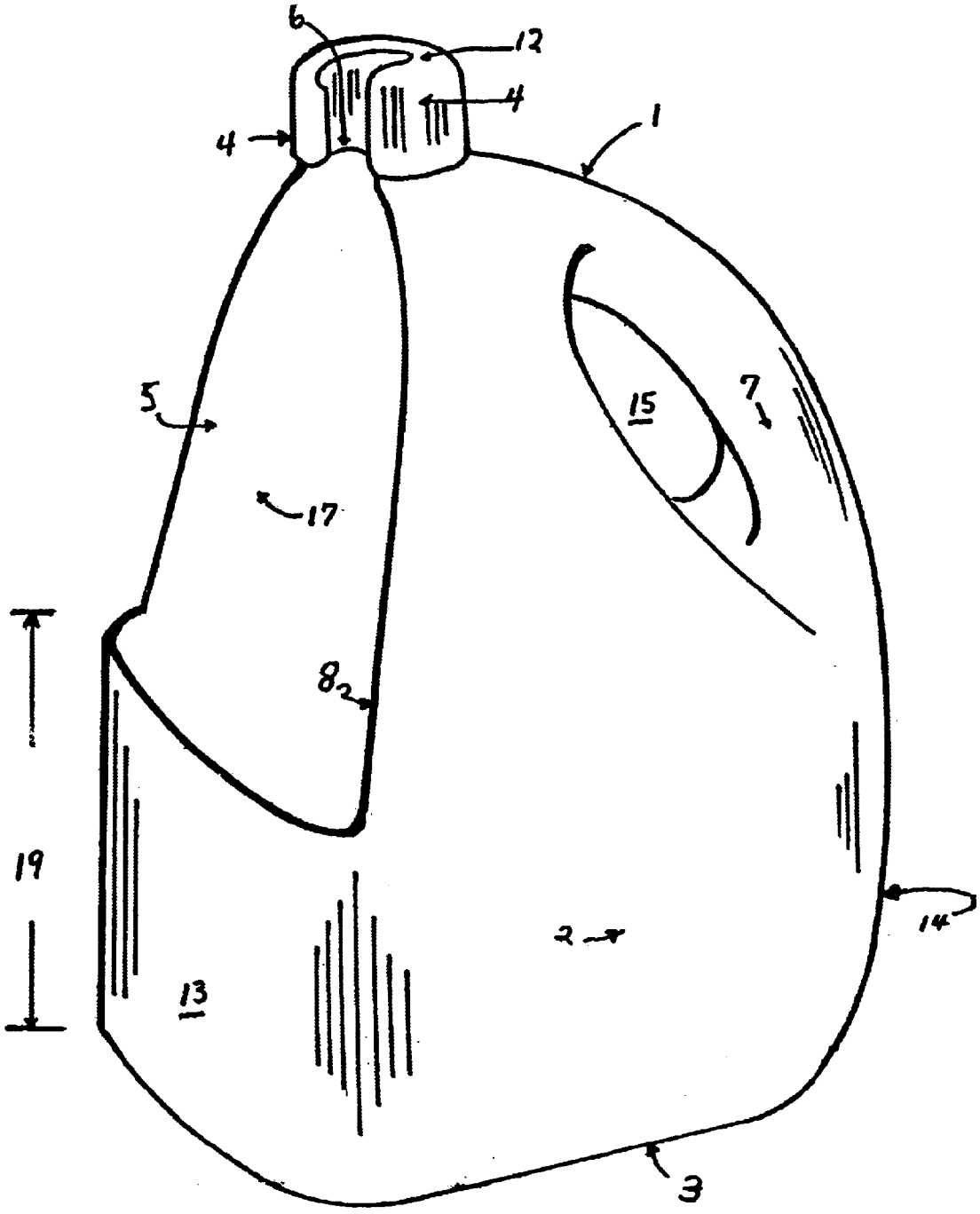
FIG. 1 is a perspective view of the paint and paintbrush carrier.

As per FIG. 1, a paint and paintbrush carrier (1) is, in the preferred embodiment, a container comprising a body having a hollow interior, a means for introducing paint into the hollow interior and a means for removably retaining a paintbrush having at one end a handle and at an opposite end a plurality of bristles such that the bristles are sheltered within the hollow interior and the portion of the handle which is generally held by the hand of a painter is maintained outside the container such that the opportunity for contact between the handle and wet paint within the hollow interior is minimized.

The body has a bottom (3), a first upstanding side wall (2), a second upstanding side wall (17) the first and second upstanding side walls both being attached to the bottom, a front wall (13), and a rear wall (14), the front and rear walls both being upstanding and attached to the bottom, the front wall and the rear wall further joining the side walls in spaced relationship, a neck (4) directly attached to the side walls and rear wall, the neck further merging into a closed top surface (12), a first opening (5) and second opening (6). It is preferred for the container to also incorporate a carry handle (7), the carry handle preferably being formed together with the container. This may be easily understood and accomplished by having the handle (7) defined by an elongated aperture (15) in the in the container, the aperture passing through the side walls such that the handle is thereby defined, the interior of the handle being hollow and in communication with the hollow interior. The container walls, bottom and neck together defining the periphery of the hollow interior. It is this hollow interior which may be referred to as a sheltered area (8). The sheltered area (8) may be accessed through both the first opening (5) and the second opening (6).

Figure 2:
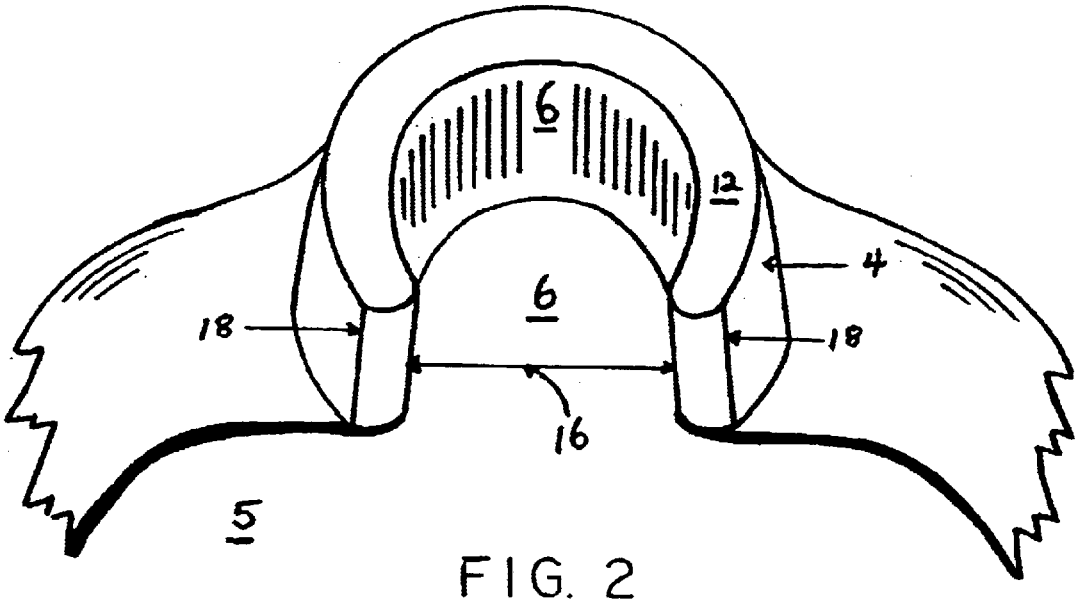
FIG. 2 is a perspective view of the second opening.
Figure 3:
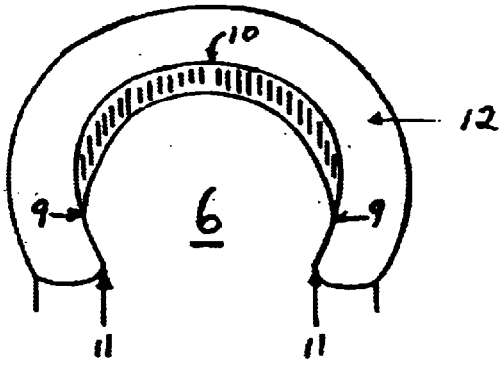
FIG. 3 is an overhead plan view of the second opening.

As per FIGS. 1, 2 and 3, the second opening (6) preferably passes through the top surface (12) of the container, distally from the bottom (3), and through that portion of the neck (4) proximate to the top surface (12) and opposite from the handle (7). As per FIG. 3, in the preferred embodiment, the second opening is nearly tear-drop shaped or nearly "U" shaped, when viewed from above the top surface (12), looking downwardly toward the bottom (3). It is referred to as "nearly" tear drop shaped in that normally a two dimensional representation of a tear-drop has a rounded end and an opposite pointed end and a pair of curved sides connecting the ends. In the preferred embodiment of the second opening found in the instant invention, the rounded end is present, however, the pointed end is not. It is unimportant whether the "tear drop" sides are curved or linear in form. With particular reference to FIG. 3, the form of the first opening, when viewed from above, is also similar in form to a "U" shape in which the two legs (9) of the "U" extending away from the arc (10) are tangential to one another rather than parallel such that the two legs nearly meet at their terminating ends (11). For purposes of general understanding, it is preferable that the arc (10), the two legs (9) and the terminating ends (11) be horizontally co-planar.

It should be understood that the "nearly U-shaped" or "nearly tear drop-shaped" appearance of the second opening when viewed from above is merely the preferred shape. Other shapes including, but not limited to a nearly triangular-shaped (two of three corners being complete) would work equally well. In the preferred embodiment, So long as the shape and dimensions of the second opening are such so to permit the passage therethrough of a paintbrush handle, in the manner disclosed below, and so long as the paintbrush will be removably retained as disclosed below, then the particular shape and dimensions of the second opening may be easily varied in keeping with the claims which follow. The detailed description of the shape of the second opening, and any dimensions which follow are merely provided to enable one skilled in the art to practice the instant invention without resorting to undue experimentation.

In addition to the second opening (6) passing through the top (12) of the container (1), it is necessary that the second opening also pass through a portion of the neck (4). The second opening (6), when viewed in perspective from the front side (13) of the container, as per FIG. 2, is essentially a slot having a pair of spaced apart side edges (18). The "slot" portion of the second opening which passes through the neck (4), and the nearly "U" shaped portion of the second opening passing through the top (12) are continuous with one another, thus permitting an elongated object (such as a paintbrush handle) having width or thickness less than width (16) of the portion of the second opening passing through the neck (the slot-like portion), to pass through both the slot-like portion of the second opening and the nearly "U" shaped portion of the second opening. This should be apparent given the fact that in the preferred embodiment, the terminating ends (11) of the two legs (9) are one and the same with the top-most section of the two side edges of the slot-like portion of the second opening.

As per FIG. 1, The instant invention has been further described as having a first opening (5). In the preferred embodiment, the first opening may be more particularly described as a hole passing through the front wall (13). Though the first opening passes only through the front wall in the preferred embodiment, it could just as easily pass through through a portion of the first side wall (2) and the second side wall (17) as well. In such a non-preferred embodiment, passage of the first opening through the side walls in addition to the front wall would result in a larger first opening, which could be especially useful when using larger paint brushes.

Figure 4:
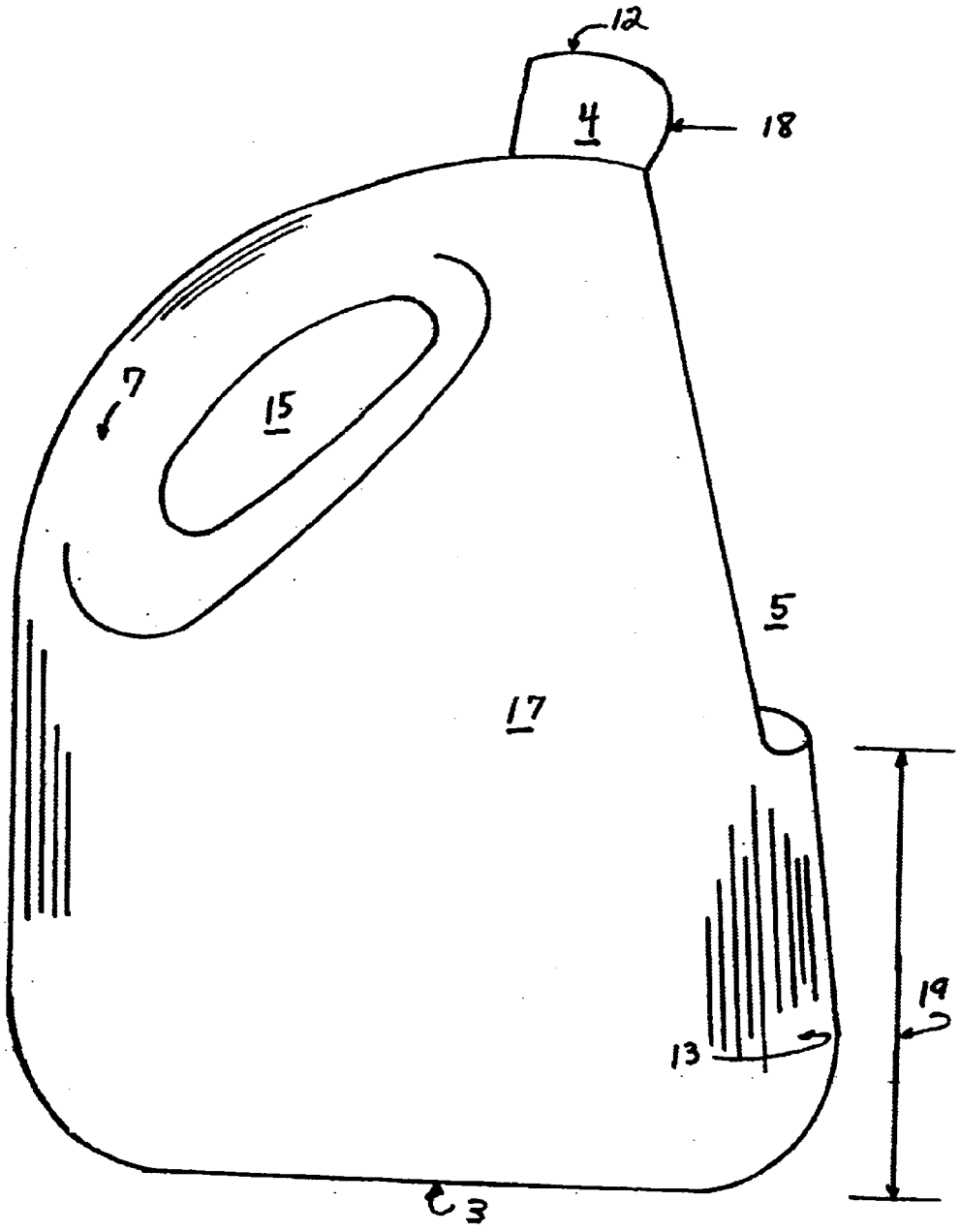
FIG. 4 is a side elevational view of the paint and paintbrush carrier.

It is instructive to note that, as per FIGS. 1 and 4, the amount of wet paint which may be stored in the sheltered area is largely dependent upon the front wall height (19). It was earlier pointed out that the first opening (5) passes through the front wall (13). By varying the front wall height (19), the amount of wet paint which may be contained by the instant invention is thereby modified as well. For example, a front wall height which is greater will permit a greater volume of wet paint to be stored, while a front wall height which is lesser will permit a smaller volume of wet paint to be stored. In the preferred embodiment, wherein a container having a hollow interior space capable of storing one gallon of water, for example, is used, it is preferred to have a front wall height of approximately 9 centimeters. A front wall height greater than this amount will permit storage of more wet paint, but at the same time tend to make insertion of the end of the paintbrush having the bristles require more coordination and careful insertion. On the other hand, a front wall height less than this amount will make insertion of the brush a simpler task, but tends to reduce the amount of wet paint which is stored within the container. When a one gallon container as set forth above is utilized, the total container height from the bottom (3) to the top surface (12) will be approximately 24 centimeters, the interior width from first side wall (2) to second side wall (17), said width being measured proximate to the bottom (8) will be approximately 14 centimeters, and interior depth when measured from the front wall (13) to the rear wall (14), proximate to the bottom (8) will be approximately 18 centimeters. These measures are provided merely for the convenience of one skilled in the art, and may easily be modified in keeping with the disclosure and scope of the claims.

It will be further understood, as per FIGS. 1 and 2 that the first opening (5) and the second opening (6) are continuous with one another, thus permitting communication through the first opening, the slot portion of the second opening and out the top surface (12) through the portion of the second opening passing through the top surface.

It should be noted that while the top surface (12) has been described as merging into the neck, it is entirely possible that the top surface could be a separate element of the invention, detachable therefrom. This may easily be accomplished by having the neck include top surface attachment means, and the top surface having corresponding neck attachment means. For example, the neck could terminate distally from the bottom and be open for communicating with the hollow interior and further include external helical threads. The top surface could be a "cap" having an upper portion and a skirt depending therefrom, the skirt having internal helical threads for threadably engaging the neck external threads. In such an embodiment, the second opening would pass through the upper portion in the same manner as described in the disclosure of the top surface of the preferred embodiment, the second opening further passing through a portion of the skirt in the same manner as described in the disclosure of the neck of the preferred embodiment. Furthermore, in this embodiment it is still necessary for the "slot-like" portion of the second opening to pass through the neck in the manner described in the disclosure of the neck of the preferred embodiment. When configured in this fashion, the "top surface" becomes removable. When fully attached to the container, the "slot-like" portion of the second opening passing through the neck, and through the skirt, will be aligned with one another such that the brush handle may be passed through the second opening.

It is believed that the above disclosed alternate embodiment of the instant invention is particularly useful when the container is to be used as a funnel for purposes of returning wet paint temporarily held within the sheltered area back to the container in which the paint is to be stored for an extended period of time. This is because when utilizing the instant invention in this fashion, removal of the top surface provides a larger opening which is essentially unobstructed. Such an unobstructed (open) neck tends to permit the passage therethrough of wet paint more rapidly and with less chance of accidental spillage than does the preferred embodiment. Furthermore, cleaning of the hollow interior following the use of the device as a funnel is simplified in that the top surface may easily be removed and cleaned separately.

For clarity's sake, the instant invention's use as a funnel will now be briefly set forth. With the device having wet paint stored within the sheltered area, and with the container into which the wet paint is to be poured (e.g., paint can) located behind the device, proximate to the rear wall (14), one tilts the device backward, toward the paint can, elevating the bottom (3) such that the front wall (13) is tilted upwardly and the top surface (12) is tilted downwardly, toward the paint can, thereby permitting wet paint within the sheltered area (8) to flow through the hollow handle (7) and out of the second opening (6). In the event that the detachable top surface has been utilized, one merely removes the cap prior to using the device as a funnel, thereby allowing the wet paint to exit the container through the open neck.

It should be further noted that the neck itself may be formed to perform the same function as the neck/top surface combination. As per FIGS. 12 and 13, this is easily accomplished by having the neck shaped in what may basically termed a "horseshoe" or even semi-circular configuration. That is, when viewed from above (and a trans-axial cross section), the neck appears much like a horseshoe or semicircle. There is still a top surface (12), however, in this embodiment the top surface is merely the terminating surface of the neck. Obviously, the width of the top surface in this case is simply the thickness of the wall which defines the neck. The thickness of the wall which defines the neck may be easily modified to suit various paintbrush handle dimensional requirements, so long as the paintbrush handle may be removably lodged in the second opening as disclosed in the aforementioned embodiments.

It is useful at this point to provide a simplified description of the sort of paintbrush which functions optimally with the instant invention. Although the paintbrush itself is not the subject of the claims, operation of the device will be more definite with an understanding of the basic paintbrush form.

Figure 5:
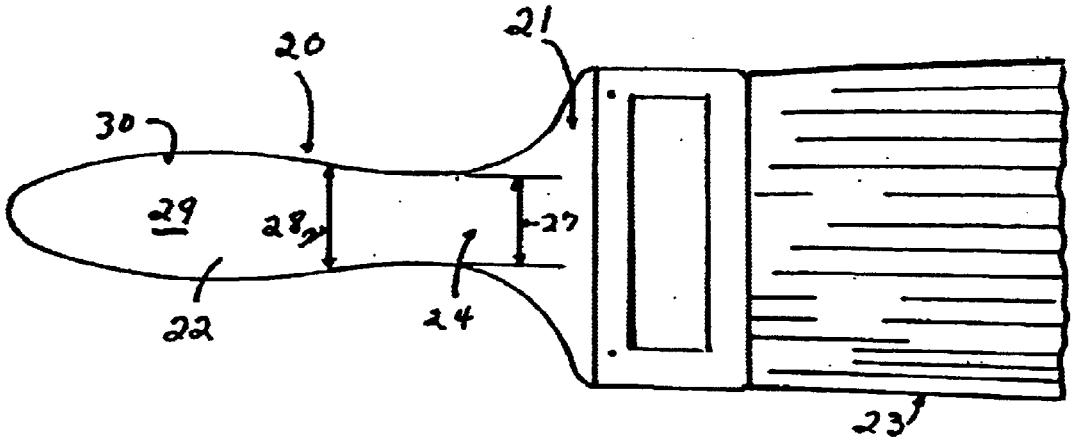
FIG. 5 is an overhead view of a paintbrush.
Figure 6:
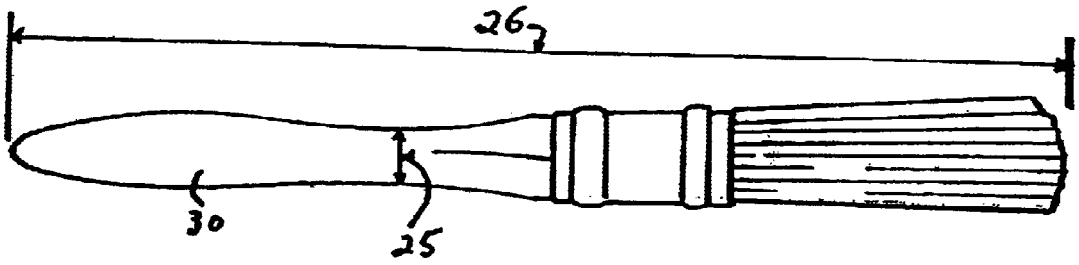
FIG. 6 is a side elevational view of a paintbrush.
Figure 7:
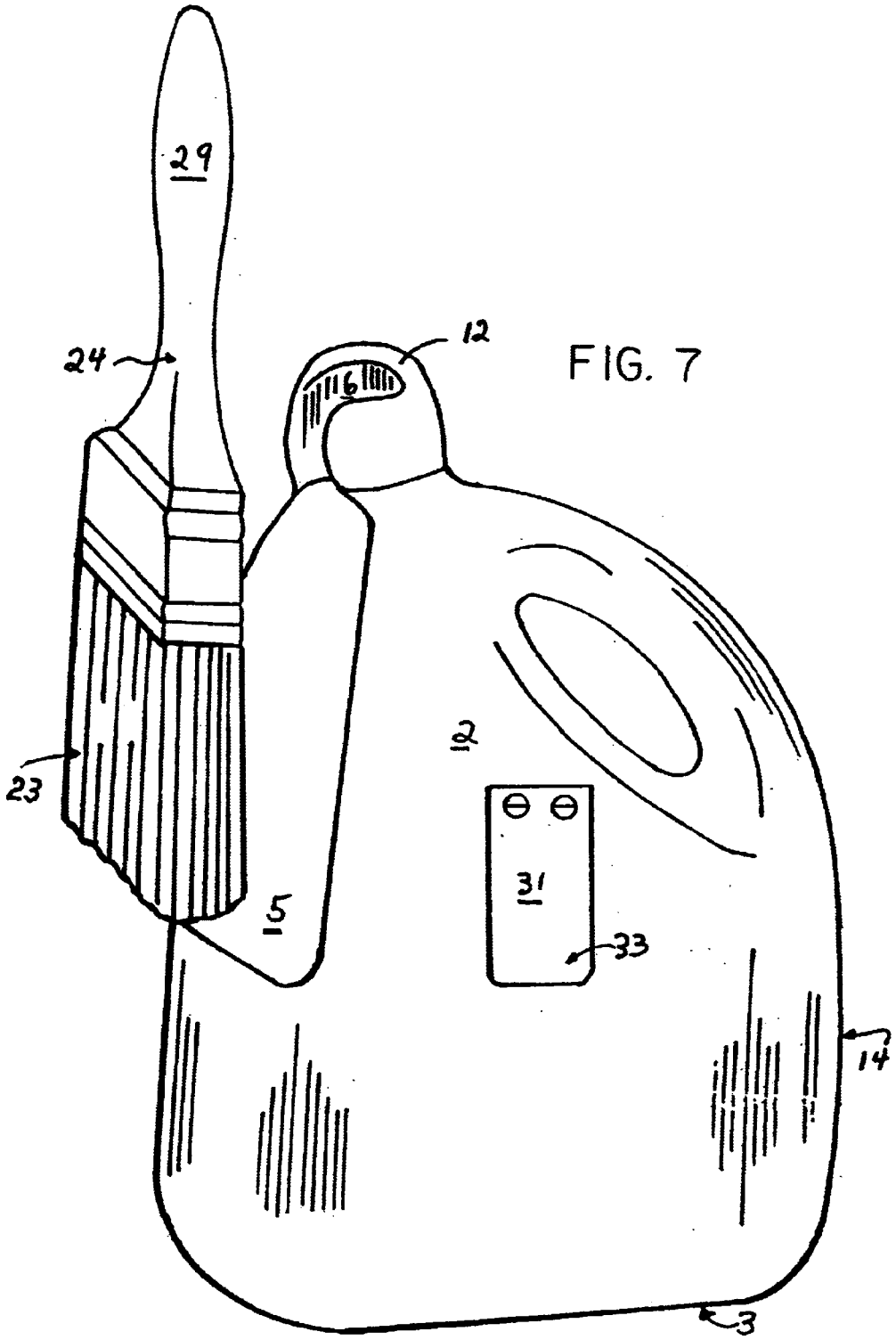
FIG. 7 is a perspective view of the paintbrush being aligned for insertion into the paint and paintbrush carrier.
Figure 8:
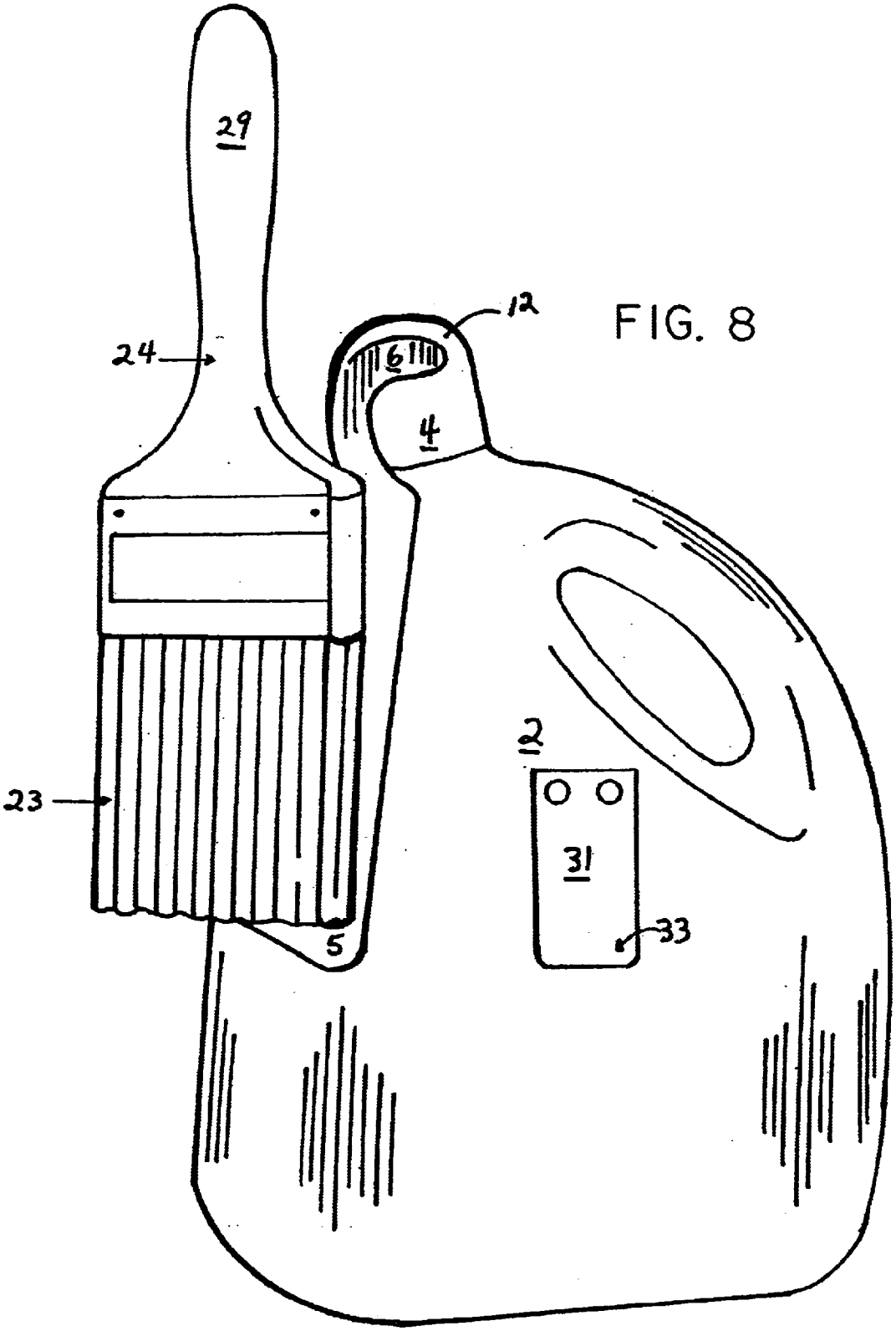
FIG. 8 is another perspective view of the paintbrush being inserted into the paint and paintbrush carrier.

As per FIGS. 5 and 6, the basic paintbrush (20) form ideally suited for use with the instant invention includes a body (21) having a handle (22) extending outwardly therefrom. The body further has a plurality of bristles (23) which extend outwardly from the body. The body further has a narrow portion (24) located between the bristles (23) and the handle (22), and a wide portion (28) located distally of both the bristles and the narrow portion, a front surface (29) and a back surface (30). It is the narrow portion (24) which will cooperate with the second opening to permit removable retention of the paintbrush by the instant invention. The paintbrush as above described is most often referred to as a "beaver-tail style handle" type.

While the narrow portion of the paintbrush body is especially important to the instant invention, the paintbrush thickness (25) also plays a part in the operation of the invention. By way of non-limiting example, the instant invention in its best mode is used with a paintbrush having an overall length (26) of approximately 25 centimeters, handle thickness (25) of approximately 1 centimeter when measured at the narrow portion (24) and a narrow portion width (27) of approximately 2 centimeters. However, while the above measures describe the "ideal" paintbrush for use with the instant invention, those measures may vary from paintbrush to paintbrush so long as the narrow portion width

(27) is greater than the handle thickness (25) at the narrow portion. It should also be noted that the proportions of the paintbrush should be such that when said paintbrush is removably engaged in the second opening, the bristles may contact the wet paint stored in the sheltered area. Obviously, this can easily occur by having longer bristles, having a longer overall length paintbrush, or even by increasing front wall height so as to permit a greater quantity of wet paint to be stored within the sheltered area. However, it is not a requirement that the bristles be in contact with the wet paint when the paintbrush is engaged in the second opening. Rather, it is merely a enabling disclosure for purposes of better understand the objects of the invention.

Use of the instant invention will now be disclosed with particularity for purposes of demonstrating the device's best mode of operation. With reference to FIGS. 1, 2, 3, 5, 6, 7, 8, 9, and 10, wet paint may be poured from its container (such as a paint can) through the first opening (5), the wet paint occupying the storage area (8). Only so much wet paint is poured in so that the wet paint does not overflow the front wall (13).

Next, having used wet paint located within the storage area, and desiring to put the wet paint soaked paintbrush down, the painter removably engages the paintbrush handle (22) in the second opening (6). This may most easily be accomplished by holding the paintbrush oriented such that the bristles point downwardly, toward the bottom (3), with the overall length (26) of the paintbrush being oriented parallel to the front wall height (19). In this position, the end of the handle most distal from the bristles (23) will be pointed upwardly, away from the bottom (3).

Next, the painter should align the paintbrush handle so that the narrow portion (24) may pass through the slot of the second opening (6). When using the sort of paintbrush described above, the narrow portion (27) is greater than the handle thickness (25) at the narrow portion. Furthermore, the width (16) of the slot portion of the second opening should be less than the narrow portion (27) of the paintbrush handle, but equal to or greater than the thickness (25) of the paintbrush handle at the narrow portion. Therefore, insertion of the handle within the second opening is accomplished by orienting the paintbrush handle such that the narrow portion may pass between the pair of spaced apart side edges (18) of the slot portion of the second opening. In so doing, the bristle portion of the paintbrush (23) will pass through the first opening 95).

Obviously, given the relative dimensions of the handle thickness and handle width at the narrow portion, only an orientation of the paintbrush wherein the width of the handle is perpendicular to the front wall (13) and the rear wall (14), with the paintbrush front surface (29) and the back surface (30) in close proximity to the pair of spaced apart side edges (18) will allow the narrow portion of the handle to pass between the pair of spaced apart side edges (18) of the slot portion of the second opening.

Next, the narrow portion of the paintbrush handle having passed between the pair of spaced apart edges, the brush handle may be rotated within the second opening such that the front surface (29) and the back surface (30) are parallel to the front wall (13) and the rear wall (14). In this position, it is virtually impossible to pull the paintbrush straight forward through the second opening as the paintbrush handle wide portion (28) is wider than the slot portion of the second opening.

Finally, the paintbrush handle is released from the hand of the painter so that, under the operation of gravity, the entire paintbrush is urged downwardly, toward the bottom (3), the wide portion (28) resting on the top surface (12) and thereby preventing the entire paintbrush from falling down into the sheltered area (8). The portion of the handle beyond the wide portion (28), that is, distally away from the bristles, is thereby retained outside of the container, free from the wet paint within the sheltered area. Removal of the paintbrush from the container is simply achieved by following the above set forth steps, in reverse.

As a final note, it has been found useful to include a carry means in addition to the handle (7) for so-called "hands free" use of the instant invention. This is most easily accomplished by including a belt attachment means. In the preferred embodiment, as per FIGS. 7, 8 and 11, the belt attachment means is a rigid plate (31) having a front side surface (33) and a rear side surface (34), the rigid plate being attached to the side wall. Attachment may easily take place on either the first side wall (2) or the second side wall (17). Ideally, there should be a space (32) between the rigid plate rear side surface and the side wall. This space may easily be accomplished by including a stand off (35) between the side wall (2) and the rigid plate rear side surface (34). The rigid plate may then be attached to the side wall using means for attachment such as a nut (37) and bolt (36), the bolt passing through the rigid plate, through the stand off and through the side wall, emerging into the sheltered area within the container whereupon the nut may be threaded onto the bolt for securing same. Obviously, other attachment means would work equally well, such as rivets and screws. To use the belt attachment means, one simply tucks the belt attachment means between one's pants and a belt worn around one's waist such that the rigid plate front side surface (33) is in contact with the pants, and the rigid plate rear side surface (34) is in contact with the belt surface most proximate to the pants, when worn.

It is worth noting that while the various embodiments above have all utilized a second opening having a portion passing through the neck, such a configuration is not a necessity. The device will function even without such a "slot-like" portion communicating with the first opening. In this configuration, however, it is necessary that the paint brush handle be inserted inside the hollow interior such that the end of the paint brush handle located most distally from the brush bristles enters the second opening from below and passes upwardly through the second opening before being rotated so as to be removably seated within the second opening.

I claim:

1. A paint and paintbrush carrier comprising a bottom wall;

spaced-apart front and rear walls extending up from the bottom wall, said front wall having an upper edge and the rear wall extending appreciably above said upper edge;

a pair of opposite side walls extending up from the bottom between the front and rear walls to form an enclosure having a hollow interior, said side walls having front edges extending up from the upper edge of the front wall and said side and rear walls converging to a relatively narrow front-facing notch with an edge connecting said front edges, said notch adapted to receive a brush so that the brush hangs down vertically within said interior above the bottom wall, and a tubular carrying handle having an upper end connected to the rear wall and opening into said interior adjacent to said notch and a lower end connected to the rear wall and opening into said interior, appreciably below said upper end so that carrier contents can be poured from said interior via said handle and said notch in a controlled manner.

2. The carrier defined in claim 1 wherein each of said edges includes a flange or lip which rigidifies said edge.

3. The carrier defined in claim 1 and further including a neck extending up from said edge of the notch.

4. The carrier defined in claim 1 and further including an exterior belt attachment mounted to one of said side walls.

5. A paint and paintbrush carrier formed as a unitary molded plastic structure comprising a bottom wall;

spaced-apart front and rear walls extending up from the bottom wall, said front wall having and upper edge and said rear wall extending appreciably above said upper edge;

a pair of opposite side walls extending up from the bottom wall between the front and rear walls to form an enclosure having an interior, said side walls having upwardly-rearwardly inclined edges extending up from said upper edge of the front wall and said side and rear walls converging above said bottom wall to an upstanding neck having a front-facing notch with an edge connecting said inclined edges, said neck adapted to receive in said notch and support a handle of a brush so that the brush hangs down vertically in the enclosure above said bottom wall.

6. The carrier defined in claim 5 wherein the structure further includes a tubular carrying handle having an upper end connected to the rear wall and opening into said interior adjacent to said neck and a lower end connected to said rear wall and opening into said interior appreciably below said upper end so that any contents of the carrier can be poured from said interior via said handle and neck in a controlled manner.

* * * * *